US009564039B2

(12) United States Patent
Hermann

(10) Patent No.: US 9,564,039 B2
(45) **Date of Patent: *Feb. 7, 2017**

(54) SYSTEMS FOR MONITORING HAND SANITIZATION

(71) Applicant: Clean Hands Safe Hands, LLC., Atlanta, GA (US)

(72) Inventor: Christopher Hermann, Atlanta, GA (US)

(73) Assignee: CLEAN HANDS SAFE HANDS, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/840,995

(22) Filed: Aug. 31, 2015

(65) Prior Publication Data

US 2016/0171874 A1 Jun. 16, 2016

Related U.S. Application Data

(63) Continuation of application No. 13/639,669, filed as application No. PCT/US2011/031571 on Apr. 7, 2011, now Pat. No. 9,123,233.

(60) Provisional application No. 61/321,595, filed on Apr. 7, 2010.

(51) Int. Cl.
*G08B 23/00* (2006.01)
*G08B 21/24* (2006.01)

(52) U.S. Cl.
CPC ..... *G08B 21/245* (2013.01); *Y10T 137/8158* (2015.04)

(58) Field of Classification Search
None
See application file for complete search history.

(56) References Cited

U.S. PATENT DOCUMENTS 5,202,666 A * 4/1993 Knippscheer ..... G08B 21/245 340/541
5,223,182 A * 6/1993 Steiner ..... A61L 9/122 261/26
5,619,188 A * 4/1997 Ehlers ..... G08B 13/08 200/61.62
5,670,945 A * 9/1997 Applonie ..... G08B 21/245 340/540
5,695,091 A 12/1997 Winings et al.
(Continued)

FOREIGN PATENT DOCUMENTS

EP 2019950009364 B1 6/2006
KR 1019940008109 B1 9/1994
KR 2019950009364 Y1 10/1995

OTHER PUBLICATIONS

International Search Report and Written Opinion dated Nov. 6, 2014 mailed in International Application No. PCT/US2014043278.
(Continued)

*Primary Examiner* — Travis Hunnings
(74) *Attorney, Agent, or Firm* — Morris, Manning & Martin LLP; Bryan D. Stewart, Esq.

(57) ABSTRACT

The present invention provides a hand sanitizer system that includes a proximity detector, a dispensing system and an alarm feature, and is operative to provide an indication corresponding to a person in proximity of the system failing to dispense antiseptic or other solution from the dispenser within a predetermined period of time after moving within a predetermined range of the detector.

20 Claims, 6 Drawing Sheets

(56) References Cited

U.S. PATENT DOCUMENTS 5,739,759 A * 4/1998 Nakazawa ..... G08B 3/1025 340/7.62
6,166,640 A * 12/2000 Nishihira ..... G08B 5/36 340/540
6,325,245 B1 * 12/2001 Matthews ..... A47K 5/12 222/181.1
7,375,640 B1 * 5/2008 Plost ..... A47K 5/1217 340/500
7,825,812 B2 * 11/2010 Ogrin ..... G01F 11/006 222/175
2002/0135486 A1 * 9/2002 Brohagen ..... G08B 21/245 340/573.1
2002/0175815 A1 * 11/2002 Baldwin ..... G01S 13/04 340/567
2004/0196612 A1 * 10/2004 Kraz ..... A61N 1/14 361/220
2005/0242942 A1 * 11/2005 Staats ..... G08B 3/10 340/506
2007/0121319 A1 * 5/2007 Wolf ..... A01M 1/2083 362/231
2007/0257803 A1 * 11/2007 Munro ..... G08B 21/245 340/573.1
2007/0279238 A1 * 12/2007 Smith ..... G01S 17/026 340/686.6
2008/0103636 A1 5/2008 Glenn et al.
2008/0131332 A1 6/2008 Nguyen et al.
2009/0051545 A1 * 2/2009 Koblasz ..... G08B 21/245 340/573.1
2009/0219131 A1 * 9/2009 Barnett ..... G08B 21/245 340/5.2
2010/0117836 A1 * 5/2010 Seyed Momen ..... G01S 1/70 340/573.1
2011/0025509 A1 * 2/2011 Brow ..... A47K 5/06 340/573.1
2011/0112696 A1 * 5/2011 Yodfat ..... G05D 7/0676 700/283
2011/0169646 A1 7/2011 Raichman
2011/0234407 A1 * 9/2011 Harris ..... G08B 21/245 340/573.1
2011/0310071 A1 * 12/2011 Segall ..... G09G 3/3406 345/207
2012/0218106 A1 8/2012 Zaima et al.
2013/0113291 A1 5/2013 Recker et al.

OTHER PUBLICATIONS

International Search Report dated Dec. 23, 2011 mailed in International Application No. PCT/US2011/031571.

* cited by examiner

```
list            p=12F508
#include        <p12F508.inc>
.config_MCLRE-OFF & _CP_OFF & _WDT_OFF & -intRC_OSC
        UDATA
sGPIO   res     1
        res     1
        res     1
        res     1
RCCAL   CODE 0x1FF
        res     1
MAIN  CODE 0x000
        movwf OSCCAL
start
        clrf    GPIO
        clrf    sGPIO
        movlw   b'111101'
        tris    GPIO
waiting
        btfss   GPIO, 3
        goto    silenced
        btsf    GPIO,2
        goto    engaged
        goto    waiting
```

FIG. 5A

```
engaged   movlw
          movwf dc3
dly       movlw 244
          movwf dc2
                dc1
check  btfss  GPIO,
                silenced
dly1   nop
          decfsz dc1
                dly1
dly2   nop
                dc1
                dly2
          decfsz dc2
                check
                dc3
                dly
                alarm
alarm           GPIO
                GPIO
                alarm
          Bcf         GPIO,
                silenced
```

FIG. 5B

```
silencad
                movlw
                movwf dc3
dlw             movlw 244
                movwf dc1
                      dc1
dlw1    nop
                decfsz dc1
                goto   dlw1
dlw2    nop
                decfsz dc1
                goto   dlw2
                decfsz dc2
                       dlw1
                decfsz dc3
                       dlw
                       waiting
                END
```

FIG. 5C

SYSTEMS FOR MONITORING HAND SANITIZATION

CROSS REFERENCE TO RELATED APPLICATIONS

This application is a continuation of and claims the benefit under 35 U.S.C. §120 to U.S. patent application Ser. No. 13/639,669, filed Oct. 5, 2012, entitled, "Systems for Monitoring Hand Sanitization", now U.S. Pat. No. 9,123,233, which is a National Stage entry of and claims benefit of and priority under 35 U.S.C. §371 to International Application No. PCT/US2011/031571, entitled, "Systems for Monitoring Hand Sanitization" filed on Apr. 7, 2011, which claims the benefit of and priority under 35 U.S.C. §§119, 120 to U.S. Provisional Application No. 61/321,595, filed Apr. 7, 2010, entitled, "Systems for Monitoring Hand Sanitization," all of which are incorporated herein by reference in their entireties.

TECHNICAL FIELD

The disclosure generally relates to sanitization.

BACKGROUND

Approximately 10% of patients who are admitted to hospitals acquire an infection while in the hospital. These infections are typically more serious due to problems with antibiotic resistant strains. These infections not only dramatically increase the cost of care, but more importantly are a cause of substantial morbidity and mortality. The most common method for the spread of nosocomial infections is from direct contact with health care providers' hands. As a result, the CDC has issued recommendations that healthcare providers wash their hands or use an instant hand sanitizer before and after all patient's contacts.

At the present time nearly all hospitals have installed instant hand sanitizer dispensers in all patient rooms and strategically placed signs reminding health care workers to use the dispensers. Despite this improvement, there is at best 50% compliance among health care workers. In most cases the providers are distracted with other responsibilities and simply forget.

Although there are devices designed to monitor sanitization compliance, these devices tend to be impractical in hospital settings, are prohibitively expensive to use on a large scale, and/or would require substantial renovation to implement.

SUMMARY OF THE INVENTION

A hand sanitization system is provided that provides notice to a person of proximity to the system and non-compliance with sanitization protocols. In certain embodiments, the system also provides automated monitoring of compliance with sanitation protocols.

Generally, a hand sanitization system is provided that includes a unit housing, a proximity detector mounted to the housing operative to determine proximity of a person with respect to the detector; a dispenser mounted to the housing and being operative to dispense antiseptic solution; and an alarm mounted to the housing and being operative to provide an indication to the person, the indication corresponding to the person failing to dispense antiseptic solution from the dispenser within a predetermined period of time after moving within a predetermined range of the detector.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

FIG. 5A is an appendix showing one embodiment of programming the microcontroller.

FIG. 5B is an appendix showing one embodiment of programming the microcontroller.

FIG. 5C is an appendix showing one embodiment of programming the microcontroller.

DETAILED DESCRIPTION

Systems for monitoring hand sanitization are provided, several exemplary embodiments of which will be described in detail. In this regard, such a system is designed to improve hand sanitization practices in locations such as hospitals rooms. Notably, the CDC recommends that healthcare providers wash their hands or use an antiseptic hand sanitizer before and after each patient contact. The system is configured to serve as a reminder to providers who enter a patient's room, for example, and forget to use a hand sanitizer. If a provider walks by a system sensor and does not use the sanitizer during a potentially variable time period, an alarm may sound until the provider uses the sanitizer.

Figure 1:
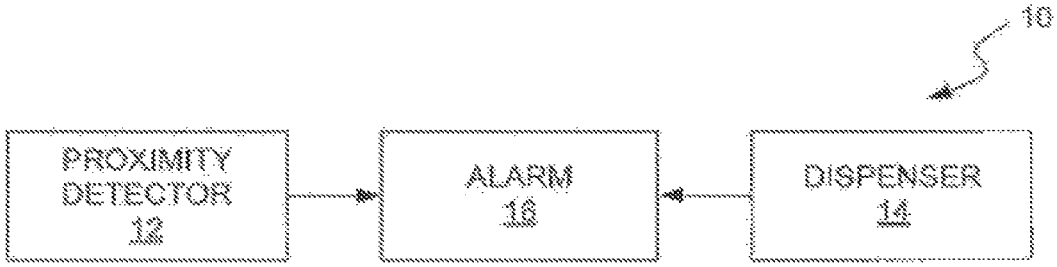
FIG. 1 is a schematic diagram depicting an exemplary embodiment of a system for monitoring hand sanitization.

An exemplary embodiment of a system for monitoring hand sanitization is depicted schematically in FIG. 1. As shown in FIG. 1, the system (10) includes a proximity detector (12), a dispenser (14) and an alarm (16). The proximity detector determines proximity of a person with respect to the detector. In some embodiments, the proximity detector includes an infrared range finder and a variable potentiometer operative to adjust range sensitivity of the range finder. Typically, the proximity detector is a single, non-directional sensor which detects proximity of a body to the sensor rather than movement of a body in front of the system. The dispenser typically dispenses antiseptic solution, which can be an alcohol-based solution or can be of any other type of sanitizing gel or solution, and provides an output signal to the system corresponding to dispensing of the antiseptic solution. The alarm is operative to provide an indication when there is a failure to dispense based on input criterion. In specific embodiments, the alarm sounds when the person fails to dispense antiseptic solution from the dispenser within a predetermined period of time after moving within a predetermined range of the detector. In some embodiments, the indication can be visual and/or audible. In some embodiments, the period of time is from between 1 second to about 1 minute, or between about 5 seconds and about 45 seconds, or about 10 seconds to about 30 seconds, or is set to at least 1, at least 2, at least 3, at least 4, at least 5, at least 10, at least 15, at least 20 or at least 30 seconds.

Figure 2:
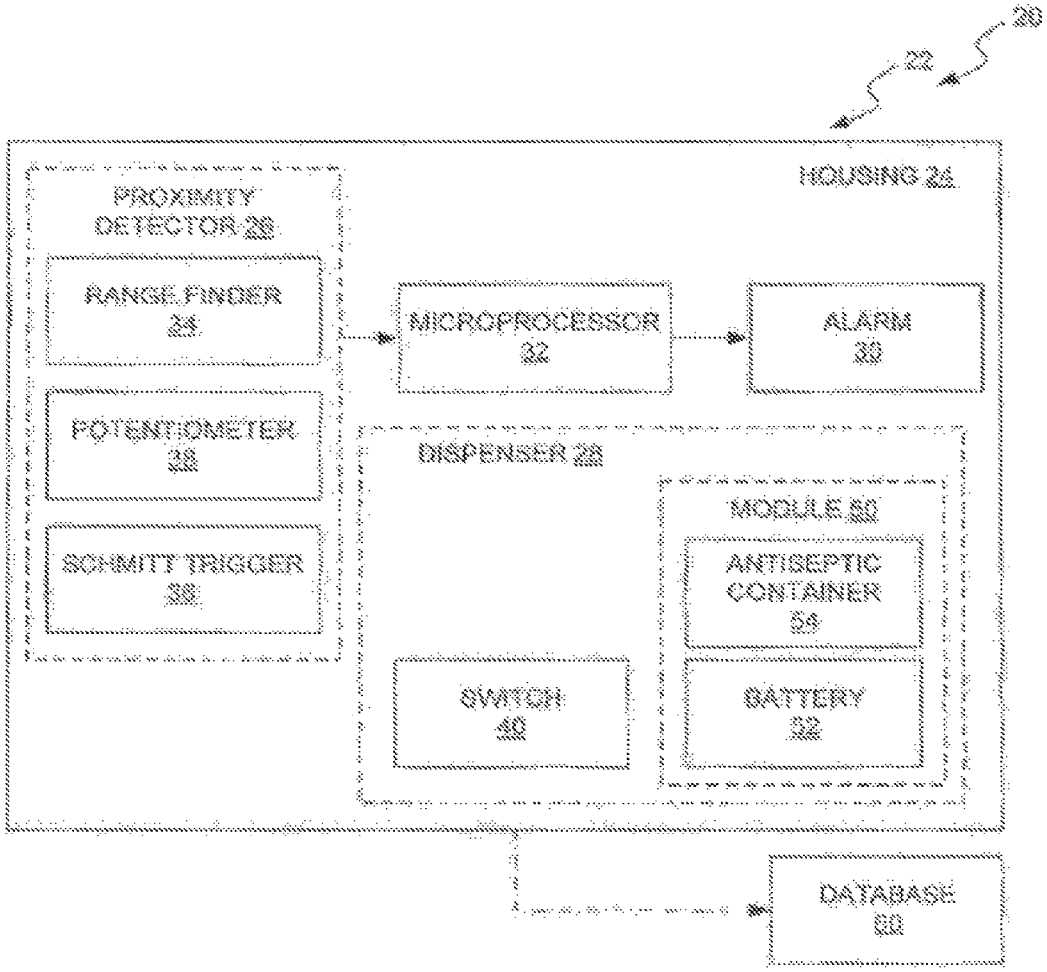
FIG. 2 is a schematic diagram depicting another exemplary embodiment of a system for monitoring hand sanitization.

Another exemplary embodiment of a system for monitoring hand sanitization is depicted schematically in FIG. 2. As shown in FIG. 2, the system 20 includes a sanitization unit 22 incorporating a housing 24, a proximity detector 26, a dispenser 28, an alarm 30 and a microprocessor 32. The proximity detector is mounted to the housing and determines proximity of a person with respect to the detector. The dispenser is mounted to the housing and dispenses antiseptic solution. The alarm is mounted to the housing and provides an indication to the person. By way of example, the indication may correspond to the person failing to dispense antiseptic solution from the dispenser within a predetermined period of time after moving within a predetermined range of the detector. Microprocessor 32 receives input from the proximity detector and from the dispenser and provides an output to the alarm based, at least in part, on the inputs received.

Figure 3:
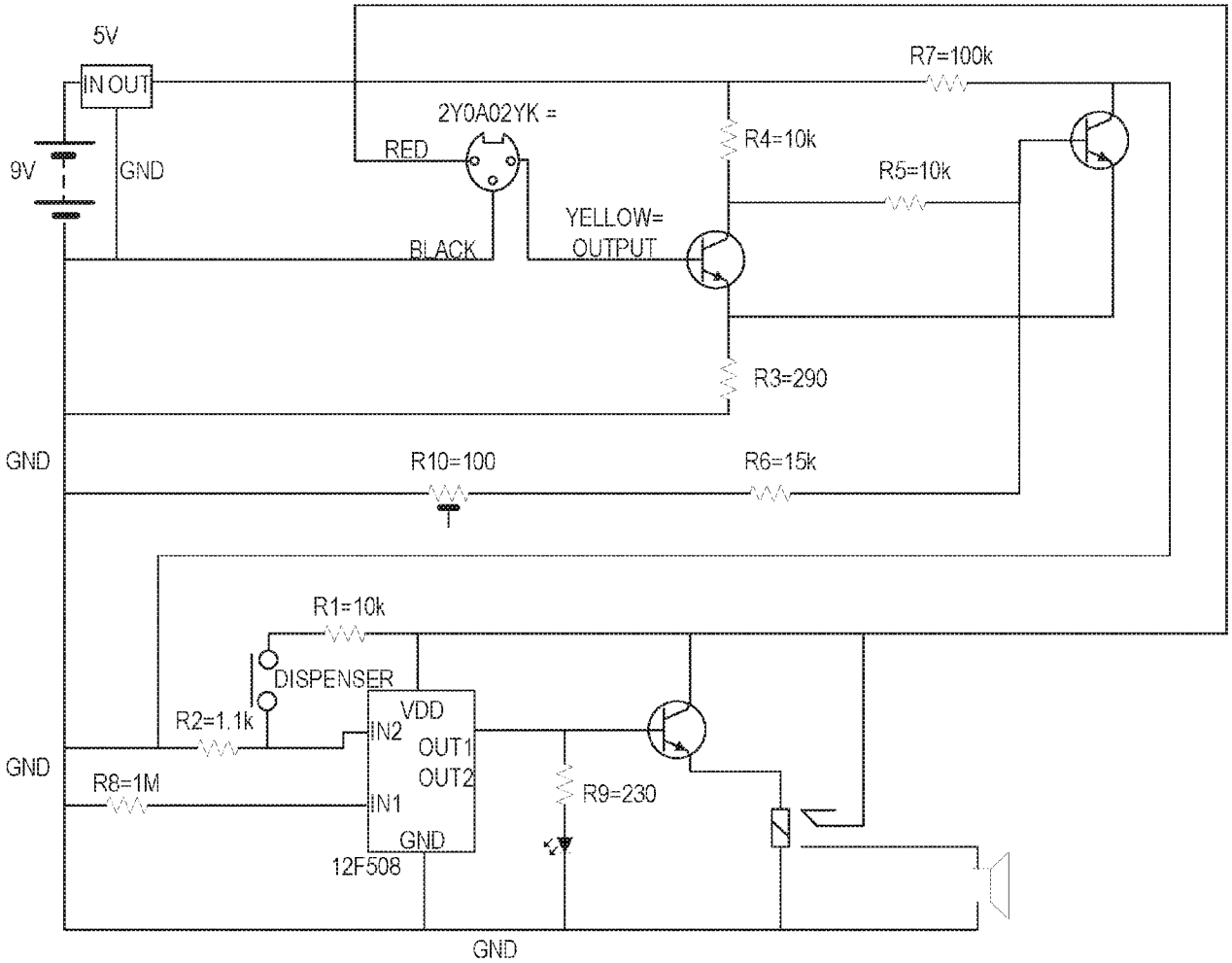
FIG. 3 is a circuit diagram related to another exemplary embodiment of a system for monitoring hand sanitization.

In the embodiment of FIG. 2, proximity detector 26 includes an infrared (IR) range finder 34, a Schmitt trigger 36 and a potentiometer 38 (also shown in FIG. 3). The proximity detector relays a signal to the microprocessor that triggers an alarm if an object enters a predetermined field without actuating the dispenser. In this embodiment, such actuation is determined by a dispenser switch 40. A representative example of a range finder is a Sharp GP2Y0A02YK infrared range finder, the output of which is processed to serve as a digital input signal to the microprocessor. The range finder is a self-contained transmitter and receiver that are set parallel to each other. If an object enters the detection field, the IR light that is transmitted is reflected to the detector. The closer an object is to the range finder, the more light is reflected, and the higher the output voltage. This exemplary detector has a range between 20-150 cm and when supplied with a 5V produces a voltage of 0.25-2.3 V depending on the distance.

The output is then converted to a digital signal with the Schmitt trigger. Notably, a Schmitt trigger is a bistable multivibrator that either produces a high or low signal depending on the input signal. The Schmitt trigger use two PNP transistors and a series of five resistors that when combined produce either a high or low voltage. If the input exceeds the $V_{on}$ value, the output from the trigger is high or $V_{cc}$. The value for $V_{on}$ is:

$$Von = \left(\frac{R6 + R10}{R4 + R5 + R6 + R10}\right)Vcc$$

If the input drops below $V_{off}$, the output from the trigger is low or ground. The value for $V_{off}$ is:

$$Voff = \frac{(R6 + R10)\left(Vcc + \frac{R4}{R3} \cdot 07Vcc\right)}{R4 + R5 + (R6 + R10) + \frac{R4(R6 + R10)}{R3}}$$

A variable potentiometer 38 is used in some embodiments to adjust an effective range of the detector. In the representative circuit of FIG. 3, R10 is a 100Ω potentiometer that when varied changes both the $V_{on}$ and the $V_{off}$. By adjusting the voltage at which the trigger is switched, the potentiometer can vary the distance at which the proximity detector produces a high output voltage.

A representative microprocessor is a Microchip 12F508 microcontroller. The microcontroller takes inputs from both the Schmitt trigger and dispenser switch 40. The dispenser switch is connected to the hand sanitizer dispenser and closing this switch represents using the sanitizer. Based on the two inputs, the microcontroller can in turn activate the alarm. The microcontroller in this embodiment is programmed (such as shown in the attached FIG. 5) so that if there is a high signal from the Schmitt trigger (corresponding to someone walking in front of the sensor) and the dispenser switch is not closed (indicating that the sanitizer from the dispenser is not used), the alarm will sound until the dispenser switch is closed (indicating that the sanitizer has been used).

In this embodiment, there is a delay built into the program so that there is a three second delay between the time the Schmitt trigger is activated and the sounding of the alarm. This delay is incorporated so that the health care provider has adequate time to use the sanitizer before the alarm sounds. Once the dispenser switch is closed, there is a ten second period in which the alarm is silenced. This delay ensures that the alarm will not sound if the external switch is closed before or while the individual crosses in front of the sensor. Clearly, various delays can be implemented in other embodiments.

Additional features to the circuitry that could be easily added are a photo resistor and a low battery indicator. The low battery indicator could be made with a second Schmitt trigger that could be incorporated or provide input to the microcontroller so that if the battery dropped below a certain voltage (i.e. a low battery) a visual and/or audible alarm could be triggered.

The photo-resistor is a variable resistor that changes voltage based on the light that strikes the surface. This could be incorporated to detect the background light in the patient's room. This would enable the detection of whether the lights are off (i.e. a sleeping patient), and result in either a silenced or reduced volume of the audible alarm, so as not to disturb the patient.

The audible alarm that is incorporated into the device as its stands is a customizable audio recording. The recording is a voice message reminding the healthcare provider to use the hand sanitizer in the event that the user fails to do so while entering or exiting the room. The combination audio recording chip and microcontroller has the ability to play multiple recordings at varying volumes. The multiple recordings can be used to play randomly selected messages to reduce the potential of conditioning of the providers. Additionally, multiple recording could be played sequentially in the event that a provider fails to respond to the first message. The volume of the device could be adjusted based on the ambient light in the room (day/night) or could be varied based on the provider's response.

A representative audible alarm is a piezo-electric buzzer. In other embodiments, a speaker and driver can be used, among others. The microcontroller could be programmed to emit a variety of tones/buzzers or could be programmed to play a recorded message asking the healthcare provider to use the antiseptic solution. The microcontroller could also be programmed with several tones/recording as to vary the message played. This could help reduce conditioning of the health care providers resulting in them ignoring the system message.

Another feature that is included in certain embodiments is a modular antiseptic and battery pack (50 in FIG. 2). This modular pack would contain a battery 52 and a container 54 of the antiseptic solution to allow easy replacement by healthcare workers. This would simplify replacing both parts. In addition, the module could provide a continual revenue source for the company supplying the device. The modular battery/antiseptic container could also be made refillable/rechargeable to both save money and be environmentally friendly. There could be a centralized filling station that could automatically recharge the battery and also re-fill the dispenser at the same time.

Additionally or alternatively, some embodiments can incorporate a solar cell for providing power to one or more of the electronic components of the system. By way of example, a solar cell (or array of cells) can be mounted to the housing and used to recharge the system battery, such as when the lights are turned on in the room in which the housing is located.

Figure 4:
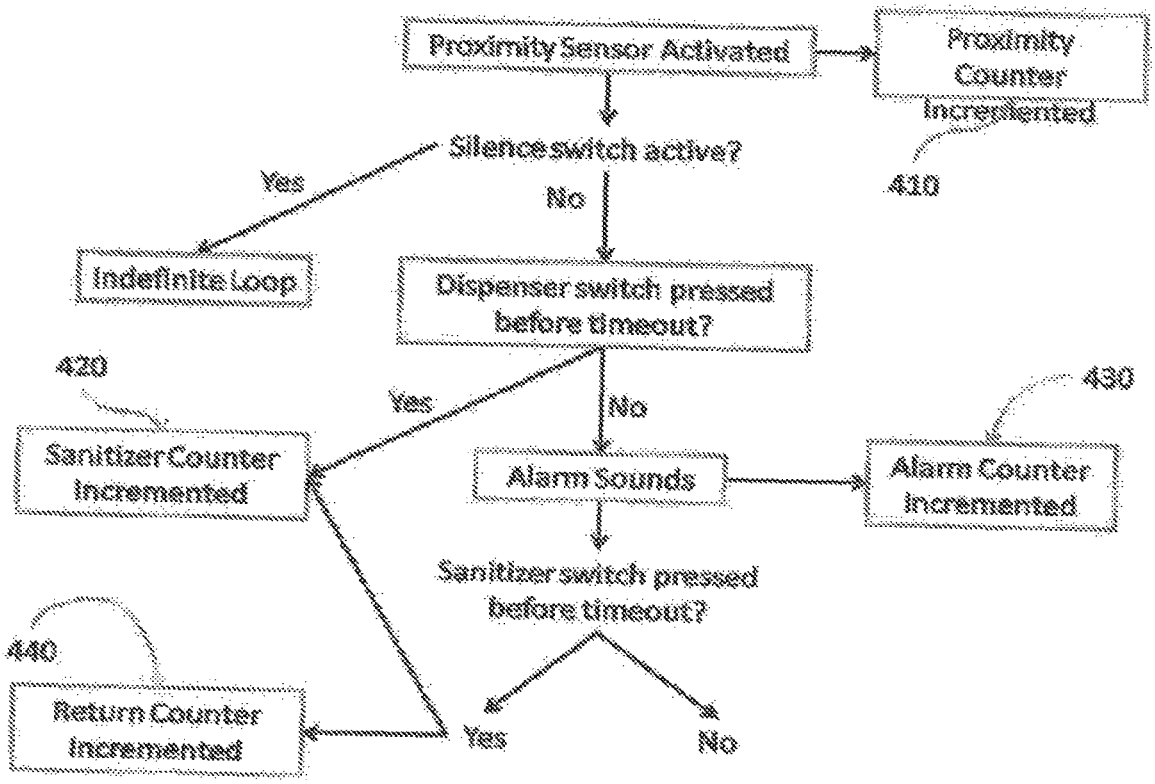
FIG. 4 is a diagram showing an exemplary detection and monitoring sequence.

The device has the ability to track the compliance of all the devices. An exemplary monitoring scheme is shown in FIG. 4. A counter is included to monitor the activation of the Proximity sensor. The proximity sensor action counter 410 can be a physical counter attached directly to the device or can be a remote program or database activated by the activation of the sensor through a wireless network. If the Dispenser dispenses, measured in this embodiment by a dispenser switch (FIG. 2, 40), then another counter 420 is used to identify if the sanitizer switch is pressed before the alarm is activated. As noted above, the period between the proximity sensor activation and alarm is set into the system. If the alarm sounds, a third counter 430 can be used to count the alarm activation. In some embodiments, a fourth "return" sensor 440 is included to identify the activation of the dispenser switch after activation of the alarm. In other embodiments, the system only provides total proximity sensor events and total dispenser activation. In other embodiments, the total alarms is included.

To better monitor the compliance/usage of the sanitizer, data associated with such use could be stored and/or transmitted to another computer/device for recording (such as in a FIG. 2, 60). In some embodiments, the microcontroller is programmed to count the number of times an individual walks past the device, the number of times the antiseptic is dispensed, and also the number of times the alarm sounds. It can also record the number of times that the alarm sounds and a provider returns to use the sanitizer. These numbers can be stored in the device and displayed sequentially on a LED display.

This information could also be transmitted to a second device (either through a wired or wireless device) that could be used to analyze the handwashing compliance. At the present time there is no hand sanitizer monitoring device that is widely used in hospitals. The hand sanitizing practices consist of dispensers that are strategically placed and signs reminding health care workers to use them. Even with these improvements the best compliance rates are just approaching 50%. The current compliance tracking requirements are based on tracking aggregate compliance and not individual provider compliance.

An advantage of this device is that it actively reminds the health care provider to use the sanitizer. The system essentially ensures that anyone who walks into or out of a patient room will use the sanitizer. If they do not use the sanitizer, an alarm will activate until the sanitizer or the silence button is pressed. There have been other devices that are designed to monitor compliance, but they tend to be impractical in hospital settings, are prohibitively expensive to use on a large scale, or would require substantial renovation to implement them. This system potentially avoids this issue in that it is stand alone, and very low cost when compared to other devices.

There are certain instances, such as during a code or withdrawal, where it is not appropriate to monitor compliance or play the audio recording. In some embodiments, the device has a switch that can silence the alarm or deactivate the compliance tracking for a predetermined or indefinite period of time.

The most important application for this device is to reduce the incidence and mortality from hospital acquired infections. Roughly 2 million patients per year acquire infections while in the hospital, resulting in approximately 80,000 deaths per year. The most common route of spread is direct contract with health care workers and the commonly accepted solution is to improve hand sanitization practices. In the U.S., there is nearly $6 billion per year spent on treating nosocomial infections, most of which is paid directly by the hospital. According to the American Hospital Association there are roughly 950,000 hospital beds in the U.S., meaning that over $6300 dollars is spent per year just to treat infections acquired while in the hospital. It is estimated that it would cost $250,000 per year (in a 250 bed hospital) for an infection control program that has only achieved a 50% compliance rate in the best of circumstances. This roughly gives a cost of $1000 per bed in each hospital for an infection control program. Multiplying this by the 950,000 beds in the U.S., given an estimate of $950 million dollars per year spent on hospital infection programs.

Various functionality, such as that described above in the flowcharts, can be implemented in hardware and/or software. In the terms of hardware architecture, such a computing device can include a processor, memory, and one or more input and/or output (I/O) device interface(s) that are communicatively coupled via a local interface. The local interface can include, for example but not limited to, one or more buses and/or other wired or wireless connections. The local interface may have additional elements, which are omitted for simplicity, such as controllers, buffers (caches), drivers, repeaters, and receivers to enable communications. Further, the local interface may include address, control, and/or data connections to enable appropriate communications among the aforementioned components.

The processor may be a hardware device for executing software, particularly software stored in memory. The processor can be a custom made or commercially available processor, a central processing unit (CPU), an auxiliary processor among several processors associated with the computing device, a semiconductor based microprocessor (in the form of a microchip or chip set) or generally any device for executing software instructions.

The memory can include any one or combination of volatile memory elements (e.g., random access memory (RAM, such a DRAM, SRAM, SDRAM, VRAM, etc.)) and/or nonvolatile memory elements (e.g., ROM, hard drive, tape, CD-ROM, etc.). Moreover, the memory may incorporate electronic, magnetic, optical, and/or other types of storage media. Note that the memory can also have a distributed architecture, where various components are situated remotely from one another, but can be accessed by the processor.

The software in the memory may include one or more separate programs, each of which includes an ordered listing of executable instructions for implementing logical functions. A system component embodied as software may also be construed as a source program, executable program (object code), script, or any other entity comprising a set of instructions to be performed. When constructed as a source program, the program is translated via a compiler, assembler, interpreter, or the like, which may or may not be included within the memory.

The Input/Output devices that may be coupled to system I/O Interface(s) may include input devices, for example but not limited to, a keyboard, mouse, scanner, microphone, camera, proximity device, etc. Further, the Input/Output devices may also include output devices, for example but not limited to, a printer, display, etc. Finally, the Input/Output devices may further include devices that communicate both as inputs and outputs, for instance but not limited to, a modulator/demodulator (modem; for accessing another device, system, or network), a radio frequency (RF) or other transceiver, a telephonic interface, a bridge, a router, etc.

When the computing device is in operation, the processor can be configured to execute software stored within the memory, to communicate data to and from the memory, and to generally control operations of the computing device pursuant to the software. Software in memory, in whole or in part, is read by the processor, perhaps buffered within the processor, and then executed.

One should note that the flowcharts included herein show the architecture, functionality, and operation of a possible implementation of software. In this regard, each block can be interpreted to represent a module, segment, or portion of code, which comprises one or more executable instructions for implementing the specified logical function(s). It should also be noted that in some alternative implementations, the functions noted in the blocks may occur out of the order and/or not at all. For example, two blocks shown in succession may in fact be executed substantially concurrently or the blocks may sometimes be executed in the reverse order, depending upon the functionality involved.

One should note that any of the functionality described herein can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" contains, stores, communicates, propagates and/or transports the program for use by or in connection with the instruction execution system, apparatus, or device. The computer readable medium can be, for example but not limited to, an electronic, magnetic, optical, electromagnetic, infrared, or semiconductor system, apparatus, or device. More specific examples (a nonexhaustive list) of a computer-readable medium include a portable computer diskette (magnetic), a random access memory (RAM) (electronic), a read-only memory (ROM) (electronic), an erasable programmable read-only memory (EPROM or Flash memory) (electronic), and a portable compact disc read-only memory (CDROM) (optical).

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A hand sanitization system comprising:

a sanitization unit having:

a housing;

a proximity detector mounted to the housing, the proximity detector operative to determine proximity of a person within a predetermined range with respect to the sanitization unit;

a proximity sensor action counter operatively connected to the proximity detector, the proximity sensor action counter for counting each proximity indication from the proximity detector indicating when the person is within the predetermined range;

a dispenser mounted to the housing and being operative to dispense antiseptic solution;

a sanitizer action counter operatively connected to the dispenser, the sanitizer action counter for counting each time the dispenser is activated;

an alarm mounted to the housing and being operative to provide an indication to the person, the indication corresponding to the person failing to dispense antiseptic solution from the dispenser within a predetermined period of time after moving within the predetermined range of the sanitization unit, wherein the predetermined period of time is adjustable; and an alarm counter operatively connected to the alarm, the alarm counter for counting each time the alarm is activated.

2. The system of claim 1, wherein the proximity detector is an infrared range finder.

3. The system of claim 1, wherein the indication is an audible indication.

4. The system of claim 1, wherein the indication is a recorded voice message.

5. The system of claim 1, wherein the sanitization unit further comprises a photo-sensor operative to determine ambient light in a vicinity of the unit.

6. The system of claim 5, wherein:

the indication is an audible indication; and the sanitization unit is operative to adjust an audio level of the audible indication based, at least in part, on the ambient light level in the vicinity of the unit.

7. The system of claim 1, wherein the sanitization unit further comprises a replaceable antiseptic module for providing a reservoir of antiseptic solution for being dispensed by the dispenser.

8. The system of claim 7, wherein the replaceable antiseptic module has a battery operative to power at least the dispenser of the sanitization unit.

9. The system of claim 1, further comprising a computer memory storing a database, the database comprising information corresponding to use of the sanitization unit.

10. The system of claim 9, wherein:

the sanitization unit is a first of multiple sanitization units; and the multiple sanitization units provide information for populating the database.

11. A hand sanitization system comprising:

a proximity detector for mounting to a sanitizer housing operative to determine proximity of a person with respect to the detector, the proximity detector operatively connected to at least one processor and having a variable range finder, wherein the sanitizer housing comprises a dispenser operative to dispense antiseptic solution;

an alarm operatively connected to the at least one processor and operative to provide an indication to the person, the indication corresponding to the person failing to dispense antiseptic solution from the dispenser within a predetermined period of time after moving within a predetermined range of the detector;

a proximity detector action counter operatively connected to the proximity detector, the proximity detector action counter for counting each proximity indication for the proximity detector indicating when the person is within the predetermined range;

a sanitizer action counter operatively connected to the dispenser for counting each time the dispenser is activated; and an alarm counter operatively connected to the alarm, the alarm counter for counting each time the alarm is activated.

12. The system of claim 11, wherein the indication is a voice reminder.

13. A system for automatically providing a natural-voice reminder to use an antiseptic solution, the system comprising:

a proximity detector for mounting to a sanitizer housing operative to determine proximity of a person with respect to the detector, the proximity detector operatively connected to at least one processor and having a predetermined range;

a sanitizer action counter operative for detecting and counting each time a dispenser is activated, wherein the dispenser dispenses antiseptic solution and the sanitizer action counter is operatively connected to the at least one processor;

a speaker for playing an audible alarm, the speaker operatively connected to the at least one processor;

memory for storing an audible alarm, the audible alarm comprising a recorded natural voice message reminder for reminding a person to dispense the antiseptic solution from the dispenser within a predetermined period of time after moving within the predetermined range of the detector; and the at least one processor, wherein the at least one processor is configured for, upon receiving an indication that a particular person is within the predetermined range of the detector and the dispenser has not dispensed the antiseptic solution with the predetermined period of time, playing the audible alarm via the speaker.

14. The system of claim 13, wherein the recorded natural voice message reminder is re-recordable.

15. The system of claim 13, wherein:

the memory is configured for storing more than one recorded natural voice message reminders; and the at least one processor is configured for enabling a user to select at least one of the more than one natural voice message reminders for playing upon receiving the indication that the particular person is within the predetermined range of the detector and the dispenser has not dispensed the antiseptic solution within the predetermined period of time.

16. The system of claim 15, wherein the at least one processor is configured for playing the at least one natural voice message reminder of the more than one natural voice message reminders upon receiving an indication of a particular event or at random.

17. The system of claim 16, wherein receiving the indication of the particular event is based on a predetermined event or on receiving an indication of a predetermined event from a sensor operatively connected to the at least one processor.

18. The system of claim 13, wherein the system comprises a housing, the housing for mounting to the sanitizer housing and comprising the proximity detector, the sanitizer action counter, the speaker, the memory, and the at least one processor.

19. The system of claim 18, wherein the at least one processor is further configured for transmitting an indication of the number of times the sanitizer action counter detects the activation of the dispenser to a central computing device.

20. The system of claim 19, wherein:

the housing is a first housing;

the system further comprises a second housing comprising a second at least one processor, wherein the second at least one processor is configured for transmitting an indication of a number of times a second sanitizer action counter detects activation of a second dispenser to the central computing device.

* * * * *